US006073932A

United States Patent [19]

Elliott

[11] Patent Number: 6,073,932

[45] Date of Patent: Jun. 13, 2000

[54] TARGET RAISING AND LOWERING DEVICE

[76] Inventor: Jerry R. Elliott, 800 W. Dobbins Rd., Phoenix, Ariz. 85041

[21] Appl. No.: 09/153,971

[22] Filed: Sep. 16, 1998

[51] Int. Cl.[7] ..... F41J 1/00

[52] U.S. Cl. ..... 273/406; 273/391

[58] Field of Search ..... 273/406, 392, 273/391, 395, 390; 434/19

[56] References Cited

U.S. PATENT DOCUMENTS

| | | | |
|---|---|---|---|
| 631,175 | 8/1899 | Parnall . | |
| 863,486 | 8/1907 | Aiken | 273/406 |
| 879,670 | 2/1908 | Petry | 273/406 |
| 1,080,301 | 12/1913 | Richmond | 273/354 |
| 2,048,155 | 7/1936 | Armantrout | 273/407 |
| 4,119,317 | 10/1978 | Ohlund et al. . | |
| 4,121,356 | 10/1978 | Gambon | 434/66 |
| 4,239,234 | 12/1980 | Ward | 273/391 |
| 4,288,080 | 9/1981 | Laporte et al. . | |
| 4,501,427 | 2/1985 | Payne | 273/406 |
| 4,540,182 | 9/1985 | Clement . | |
| 5,232,227 | 8/1993 | Bateman | 273/392 |
| 5,350,180 | 9/1994 | Acock | 273/406 |
| 5,865,439 | 2/1999 | Marcuson | 273/406 |

*Primary Examiner*—Sebastiano Passaniti
*Assistant Examiner*—M. Chambers
*Attorney, Agent, or Firm*—Richard G. Harrer; Elizabeth A. Dawn

[57] ABSTRACT

The present invention is a portable pneumatic target device for raising and lowering a target. With the target raising and lowering device of the present invention, a target can be selectively stopped at any point of extension or retraction. The target raising and lowering device of the present invention includes a support frame secured to a base, a horizontal target carrier assembly mounted to the support frame and moveable on the frame, and an air actuated cylinder operably attached to the target carrier assembly. The target is mounted to the target carrier assembly and is raised and lowered through the action of the air actuated cylinder.

12 Claims, 3 Drawing Sheets

10
11
12
13
14
15
20
21
22
23
24
25
26
27
30
31
31A
33
34
35
36
37
38
40
42
43
44
45
46
47
48
50
51
52
53
54
55
81
82
83
84
85

TARGET RAISING AND LOWERING DEVICE

This invention relates to a device for raising and lowering a target for practice shooting.

BACKGROUND OF THE INVENTION

Various devices for raising and lowering targets for practice shooting are known in the art. It is an advantage when one is practicing target shooting to have a target that can raise up from a position of concealment. This allows the shooter to improve shooting skills in a more realistic environment. One such target raising and lowering device is taught by U.S. Pat. No. 863,486. In that patent, an attendant manipulates a pulley system which raises one target while at the same time an opposing target is lowered. U.S. Pat. Nos. 4,288,080 and 4,119,317 teach a transverse shaft rotatable by a motor which is used to propel the target into an upright position. The apparatus disclosed in these patents are an improvement over U.S. Pat. No. 863,486 as a human attendant is no longer placed in harm's way. Nevertheless, these patents are limited to a fixed up and a fixed down position. Accordingly, the apparatus disclosed in these patents cannot be raised so that only a portion of the target is exposed. U.S. Pat. No. 4,540,182 teaches the use of an air-actuated cylinders to raise the target, but the target is limited to a fixed up and down position.

SUMMARY OF THE INVENTION

The portable pneumatic target device of the present invention is an improvement over the devices disclosed in the above-mentioned patents as it incorporates an air actuated cylinder utilizing a double acting piston in conjunction with a horizontal target carrier assembly. Consequently, with the present invention, a target can be quickly raised and lowered. In addition, the user can selectively stop the target at any point of extension, which creates more target-shooting challenges. Once the target is stopped at a given position, the double acting piston in the air actuated cylinder further allows the target to then be raised or lowered from that point. This invention also allows the user to control the speed at which the target is raised and lowered.

It is an object of this invention to provide for a target raising and lowering device wherein the speed at which the target is raised can be adjusted by the user.

It is an object of this invention to provide for a target raising and lowering device that can be raised to a desired extension and then stopped.

It is a further object of this invention to then allow the target device to be raised or lowered from any point of extension.

It is another object of this invention to provide for a target raising and lowering device with a narrow base that can be easily concealed behind obstructions such as barrels and furniture.

It is still another object of this invention to provide for a target raising and lowering device that can free stand or can be easily hung from a wall.

Other objects of the invention will become apparent hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
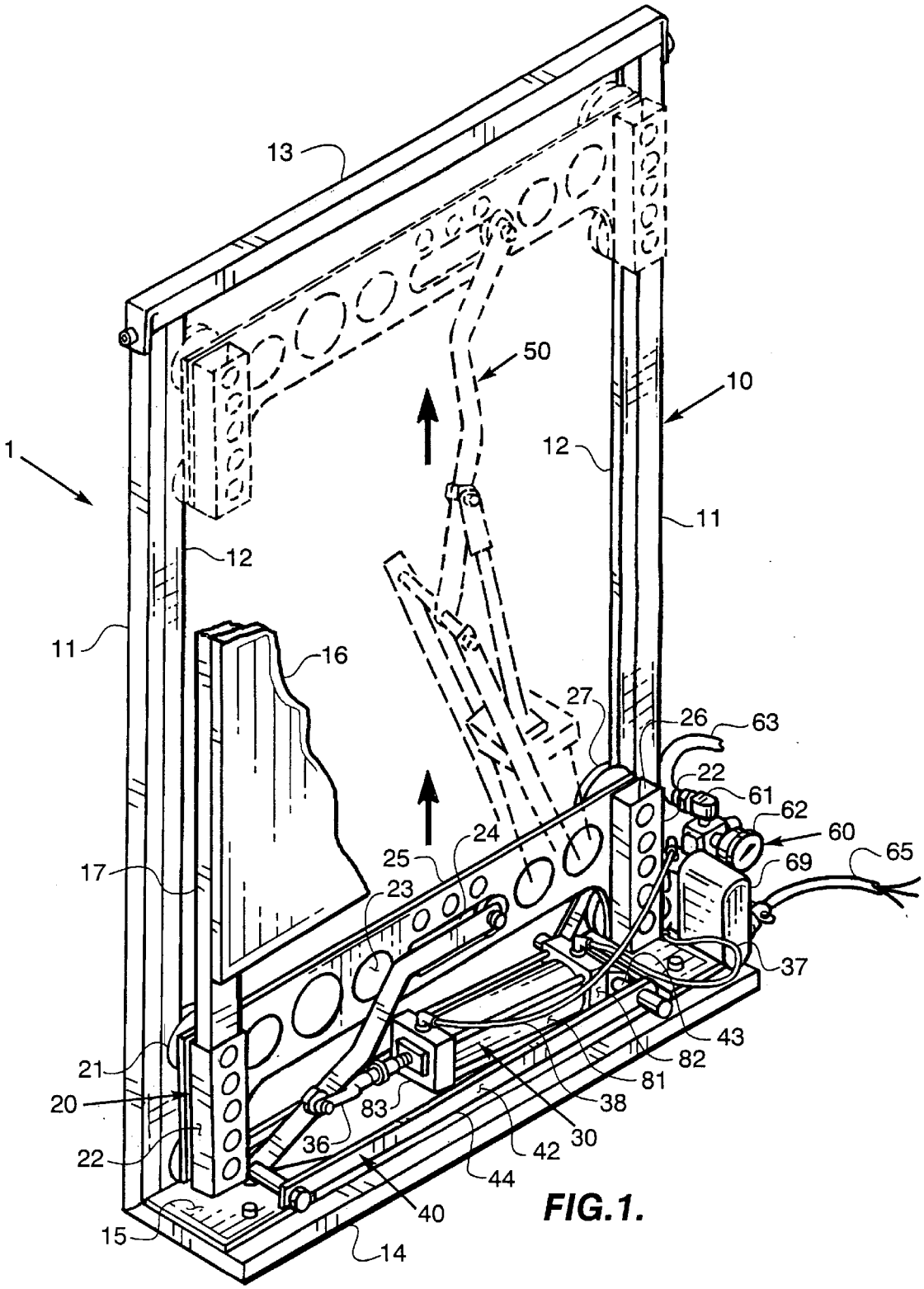
FIG. 1 is a front perspective view of the portable pneumatic target device showing the target carrier assembly 20 in a ready position. The target carrier assembly 20 is shown at its maximum extension in dashed lines.

As shown in FIG. 1, the portable pneumatic target device 1 of the present invention comprises a support frame 10, target carrier assembly 20, air actuated cylinder 30, tension arm assembly 40, idler arm 50, and solenoid control 60.

Figures 6A, 6B, 6C, 6D, 6E:
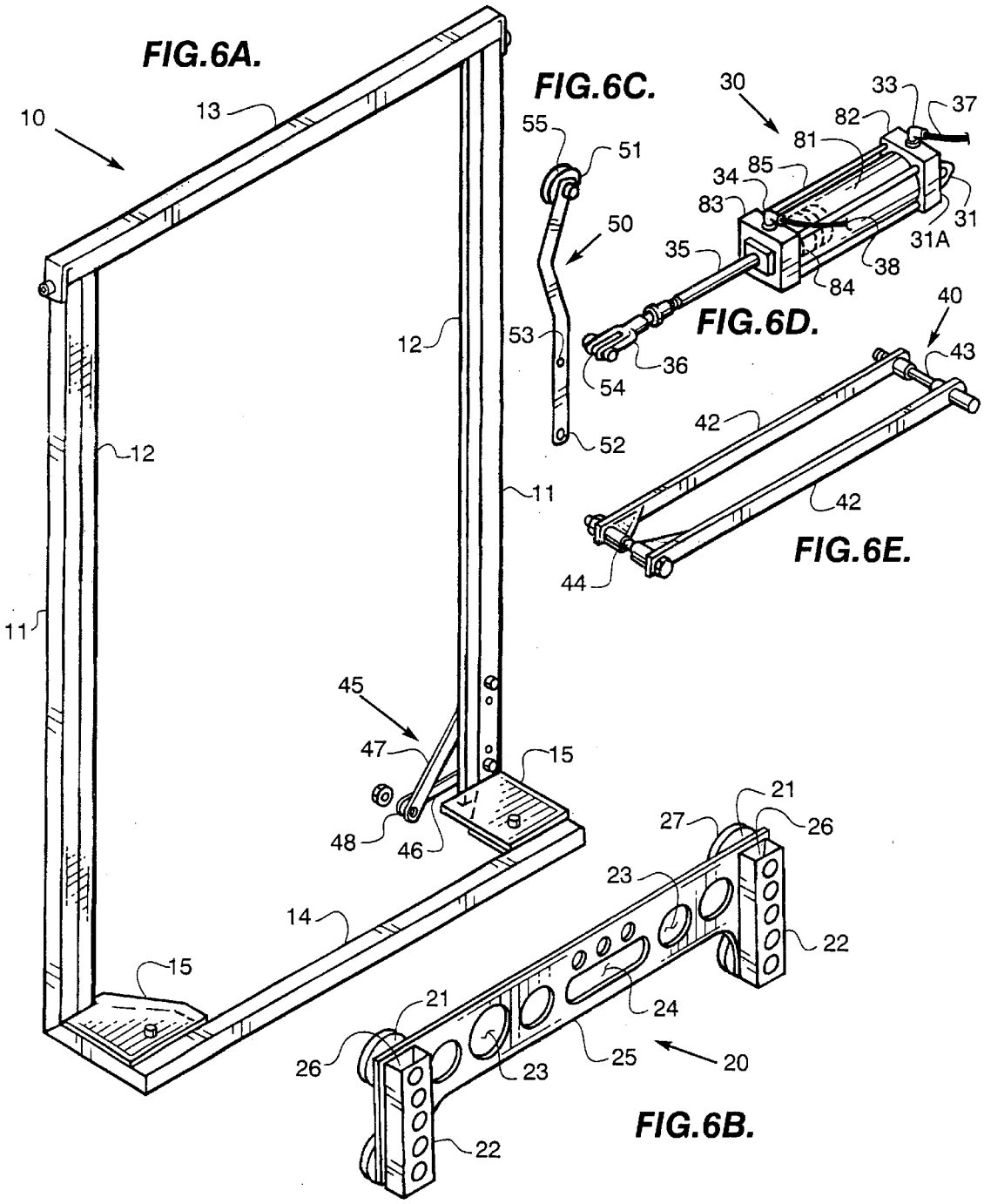
FIG. 6A is a perspective view of the support frame 10.
FIG. 6B is a perspective view the target carrier assembly 20.
FIG. 6C is a perspective view of the idler arm 50.
FIG. 6D is a perspective view of the air actuated cylinder 30.
FIG. 6E is a perspective view of the tension arm assembly 40.

As shown more clearly in FIG. 6A, the support frame 10 includes a base 14 which provides stabilizing support for the target device, and in a preferred embodiment of the invention, the base portion of the frame extends no more than about six inches in front of the frame. Rubber rebound pads 15 are affixed to the upper surface of base 14 to help absorb the impact of target carrier assembly 20 when it is returned from the raised position to the ready position and makes contact with the base. A pair of guide frame bars 11 extend vertically upward from both ends of the base 14 of frame 10. The guide frame bars 11 are connected at the top by horizontal tie bar 13 to form the generally rectangular shaped support frame 10. As shown most clearly in FIG. 4, an L-shaped carrier guide rail 12 is attached to the inner surface of each vertical guide frame bar 11.

As shown in FIG. 1, target carrier assembly 20 is positioned at the front of frame 10 and rests on base 14. As shown more clearly in FIGS. 4 and 6B, target carrier assembly 20 comprises a somewhat rectangular shaped rigid plate 25 which extends between guide frame bars 11. Cutouts 23 in plate 25 serve to reduce the weight of the assembly.

Mounted on each end of plate 25 and on the front side of the target device are target receptor brackets 22, each of said receptor brackets having a rectangular shaped cavity 26. As shown in FIG. 1, target 16 is mounted to the portable pneumatic target device by supports 17 which are inserted into cavity 26 of the target receptor brackets 22. Thus, the target can be raised and lowered along with the target carrier assembly 20.

Also mounted at each end of plate 25, and on the side of the plate opposite to the target receptor brackets 22 are rotatable guide rail wheels 21. As shown best in FIG. 4, each end of plate 25 is provided with a pair of such guide rail wheels, and each of the wheels has a groove 27 about the circumference of the wheel. The groove of each guide wheel engages with the guide rail 12 to properly guide the target carrier assembly and target in the raising and lowering operation.

The raising and lowering of the target carrier assembly 20 and target 16 is initiated through the action of air actuated cylinder 30, which is pivotally secured to frame 10 by means of tension arm assembly 40. As shown best in FIG. 6E, tension arm assembly 40 is rectangular shaped and includes a pair of spaced apart parallel bars 42. The bars are connected at one end by means of pivot shaft 43 and at the other end by pivot shaft 44.

Figure 5:
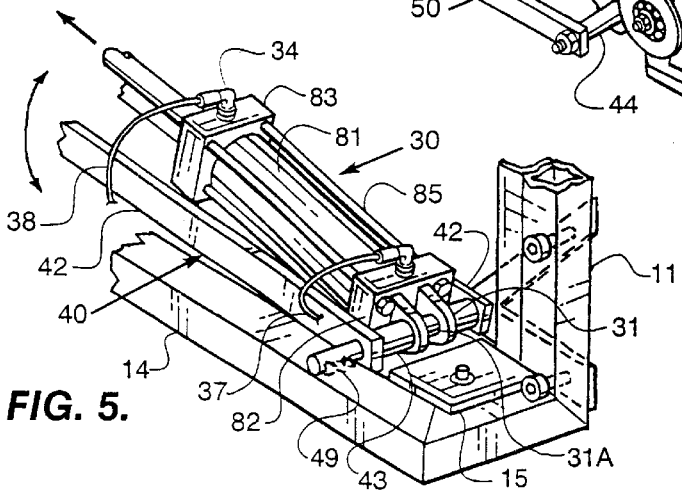
FIG. 5 is a perspective view of the tension assembly arm and air activated cylinder at their point of attachment to the support frame.

As shown in FIG. 5, the tension arm assembly 40 and air actuated cylinder 30 are pivotally attached as a unit to support frame 10 by means of pivot shaft 43 which extends between and through bars 42 at one end of the tension arm assembly 40. Support frame 10 is provided with a tension arm support 45 and, as shown best in FIG. 6A, support 45 includes horizontal brace 46 and angled brace 47 to form a generally triangular shaped support 45. The support is bolted to one of the vertical guide frames 11. As further shown in FIG. 5, on end of pneumatic cylinder 30 is provided with a pair of pivot ears 31. Pivot shaft 43 extends through one of bars 42, then through bore 31*a* of each pivot ear 31, then through the other bar 42, and then into tension arm support 45 at 48. Shaft 43 is welded on base 14 at 49. By virtue of this mounting technique, the tension arm assembly 40 and pneumatic cylinder 30 can easily pivot in an upward or downward direction.

Pneumatic cylinder 30 is preferably of the double acting piston type. That is, within the interior of the cylinder is a piston which can be actuated by fluid (either gas or liquid) under pressure. As an example, when pressurized air is applied to one side of the piston, it will cause the piston to move away from the air source. When pressurized air is applied to the opposite side of the piston, the piston will move in an opposite direction away from the pressurized air source. Thus, through appropriate valving and pressure control, one can control the direction of movement of the piston.

As shown in FIG. 5, pneumatic cylinder 30 includes cylinder body 81, heads 82 and 83 at each end of the cylinder body and tie rods 85 which firmly secure the heads to the cylinder body. Piston 84, shown in phantom in FIG. 6D, is positioned in the interior of cylinder 30. Piston rod 35 is secured to piston 84 and extends outward from the pneumatic cylinder through bead 83. As shown in FIG. 5, pneumatic hose 38 is connected to head 83 at one end of the pneumatic cylinder through fitting 34. So too, pneumatic hose 37 is connected to the opposite end of cylinder 30 to head 82 through fitting 33. Air under pressure from pneumatic hose 38 enters cylinder body 81 and can act against a side of piston 84. Air under pressure from pneumatic hose 37 enters the cylinder body 81 and can act against the opposite side of piston 84. A suitable air actuated cylinder is available from Fluid Connector Products, Inc. as model 2 1/2 PU16X8.

Figure 2:
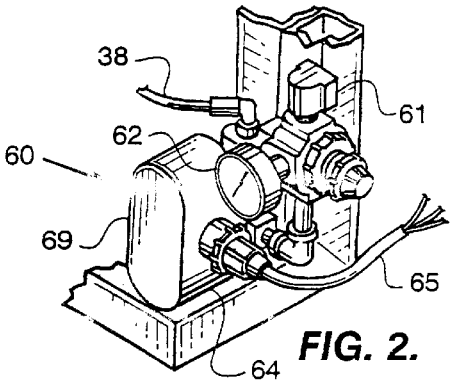
FIG. 2 is a perspective view of the solenoid control.
Figure 3:
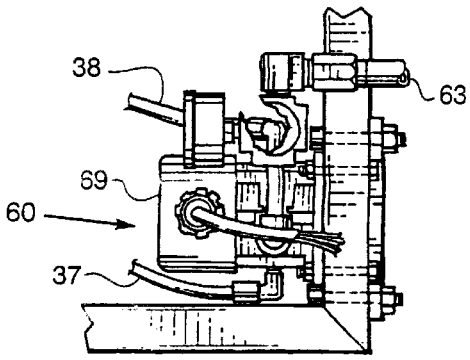
FIG. 3 is a side elevational view of the solenoid control.

Another important component in this target raising and lowering system is the solenoid activated pneumatic control 60, for it is this control, acting in concert with the other major components, that allows a target not only to be generally raised or lowered, but, in addition, allows the user to selectively stop the target at any point of extension. As shown in FIGS. 2 and 3, solenoid control 60 includes solenoid actuated valve 69, power supply cord (12V) 65, inlet air pressure hose 63, and pressure regulator 61. In one embodiment of the invention, the source of air under pressure is a compressed air cylinder, such as a scuba tank. This embodiment allows for increased portability of the invention. Because the device can be run utilizing a 12V power supply, a 12V battery, such as a car battery, can be used to power the device. Pressure regulator 61 controls the pressure of the air which enters the solenoid activated control 60. By adjusting regulator 61, the user can control the speed at which the target assembly is raised or lowered. Gauge 62 allows the user to monitor the pressure. A preferred solenoid control valve system is available from Parker Hannifin Corporation as Model 250-4E2. In the preferred embodiment of the invention, a low voltage 12 volt solenoid control is used.

To complete the components included in the target raising and lowering assembly, reference is again made to FIG. 1. As previously noted, air actuated cylinder 30 is supplied with piston rod 35, which is secured to piston 84 and extends outward from cylinder 30 through head 83. As shown best in FIG. 6D, mounted to the end of piston rod 35 is adjustable coupler 36, which is threaded to the end of piston rod 35. This allows the coupler to be adjusted lengthwise as may be necessary.

As shown in FIGS. 1 and 6C, idler arm 50 is operably connected between piston rod 35 and carrier assembly 20. More particularly, one end of the idler arm is pivotally mounted to shaft 44 of tension arm assembly 40. That is, one end of idler arm 50 has opening 52 which accommodates shaft 44. The exposed end of coupler 36 is U-shaped and surrounds the idler arm and is pivotally connected at about the mid-point of the arm by means of threaded pin 54, which goes through opening 53 of the idler arm.

Figure 4:
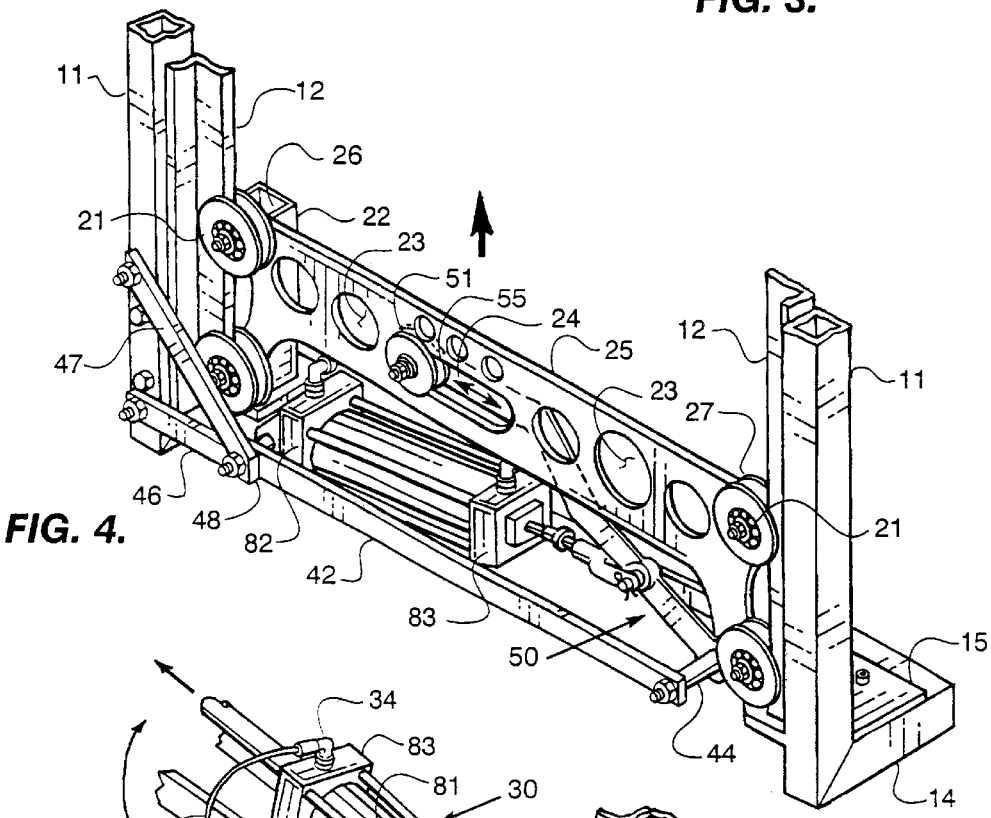
FIG. 4 is a rear perspective view of the lower portion of the target device of the present invention.

As shown in FIG. 6C, an idler wheel 51 is rotatably mounted on the end of idler arm 50 and is provided with a groove 55 about its circumference. As shown best in FIG. 6B, plate 25 of target carrier assembly 20 is provided with longitudinal slot 24. As shown in FIGS. 1 and 4, idler wheel 51 is positioned within slot 24 so that groove 55 of the idler wheel tracks on the edges of slot 24. Since idler wheel 51 is mounted on the end of idler 50, this allows the idler arm to move longitudinally within the slot.

The user controls the action of the target raising and lowering device by means of a three position switch, many types of which are commonly known in the art. The switch is attached to and supplies control input to the target raising and lowering device through wires in power supply cord 65. When the user wishes to raise the target from the ready position, the user activates the appropriate switch on the control. Cord 65 carries the signal from the control to solenoid valve 69. The solenoid valve 69 then directs pressurized air through hose 37 and into head 82 of air actuated cylinder 30. Once inside the cylinder, the pressurized air acts against the side of piston 84 nearest to head 82 causing the piston and its attached piston rod 35 to be pushed away from head 82. As best shown in FIG. 1, as piston rod 35 is pushed away from head 82 of cylinder 30, idler arm 50, attached to piston rod 35 by adjustable coupler 36, begins to assume a more vertical position. As the idler arm moves into a more vertical position, it moves the target carrier assembly 20, connected to the idler arm at the extension roller relief slot 24 by the extension roller 51, upwardly along the carrier guide rails 12. Consequently, when pressurized air acts against the side of piston 84 closest to head 82, the target carrier assembly 20 and the target it is carrying are raised.

By means of the control, the user can stop the target raising and lowering device at any point of target elevation. During the time the action of the target raising and lowering device is stopped, the solenoid valve 69 functions to balance air pressure on either side of piston 84, and thereby maintain the target at a given point of elevation.

When the user wishes to lower the device, the appropriate switch on the control is activated. The solenoid valve then allows pressurized air to flow through hose 38 and into head 83 while at the same time allowing air to flow from hose 37 and back into the solenoid valve. Pressurized air acts against the side of piston 84 closest to head 83, which causes the piston and attached rod 35 to move away from the source of pressurized air, and, therefore, away from head 83. As piston rod 35 is forced back into cylinder body 81, idler arm 50 is lowered. As idler arm 50 is lowered, target carrier assembly 20 is also correspondingly lowered. Accordingly, by means of a control switch in conjunction with solenoid control 60, air actuated cylinder 30, idler arm 50, target carrier assembly 20, and the other components of the target raising and lowering device described above, a target can be raised, lowered, or stopped at any given position using the device of the present invention.

I claim:

1. A device for raising and lowering a target and for selectively stopping the target at any point of extension or retraction comprising:

a. a support frame including a pair of spaced apart parallel guide frame bars secured to a base;

b. a target carrier assembly provided with means for receiving a target and positioned between said guide frame bars and moveable along the length of said bars;

c. means for raising and lowering said target carrier assembly and selectively stopping said assembly at a variety of points of extension or retraction, said means including:

(1) a tension arm assembly, one end of which is pivotally mounted to said support frame;

(2) a cylinder mounted to said tension arm assembly, said cylinder having a moveable piston positioned within said cylinder with the interior of said cylinder being connected to a source of fluid under pressure;

(3) means for directing said fluid under pressure to at least one side of said piston and thereby causing movement of said piston within said cylinder; and (4) means operably connecting said piston and said tension arm assembly to said target carrier assembly whereby movement of said piston results in the raising and lowering of said target carrier assembly.

2. The target raising and lowering device of claim 1 wherein said cylinder is pivotally mounted to said tension arm assembly.

3. The target raising and lowering device of claim 2 wherein said moveable piston is of the double acting type.

4. The target raising and lowering device of claim 3 wherein means are provided for selectively directing fluid flow to either side of said piston and thereby causing movement of said piston within said cylinder.

5. The target raising and lowering device of claim 4 wherein said means for selectively directing fluid to either side of said piston are valve means.

6. The target raising and lowering device of claim 5 wherein said means for operably connecting said piston and tension arm assembly includes a piston rod secured to said piston and extending from said cylinder with means for operably connecting said piston rod to said target carrier assembly.

7. The target raising and lowering device of claim 6 wherein said means for operably connecting said piston rod and said tension arm assembly to said target carrier assembly includes an idler arm, one end of which is pivotally connected to an end of said tension arm assembly, with the opposite end of said idler arm being connected to said target carrier assembly and with an end of said piston rod being connected to said idler arm at a point between the ends of said idler arm whereby movement of said piston rod is transmitted to said target carrier assembly by means of said idler arm.

8. The target raising and lowering device of claim 6 wherein said valve means are electrically controlled.

9. The target raising and lowering device of claim 8 wherein a solenoid controls said valve means.

10. The target raising and lowering device of claim 8 wherein each of said guide frame bars is provided with a guide frame rail.

11. The target raising and lowering device of claim 10 wherein said target carrier assembly is provided with guide rail wheels which engage with said guide rails.

12. The target raising and lowering device of claim 11 wherein said cylinder is pivotally mounted to said end of said tension arm assembly which is pivotally mounted to said frame.

* * * * *